United States Patent [19]

Yokoyama et al.

[11] Patent Number: 4,743,801

[45] Date of Patent: May 10, 1988

[54] LIGHT-EMITTING ELECTROLUMINESCENT DEVICE

[75] Inventors: Meiso Yokoyama; Makoto Takahashi; Hiroshi Ohkawa, all of Nagaoka, Japan

[73] Assignee: Nippon Seiki Co. Ltd., Niigata, Japan

[21] Appl. No.: 20,223

[22] Filed: Feb. 27, 1987

Related U.S. Application Data

[63] Continuation of Ser. No. 806,775, Dec. 9, 1985, abandoned.

[30] Foreign Application Priority Data

Dec. 28, 1984 [JP] Japan ..... 59-275747

[51] Int. Cl.[4] ..... H05B 33/04; H05B 33/06

[52] U.S. Cl. ..... 313/512; 313/506; 313/509

[58] Field of Search ..... 313/506, 509, 512

[56] References Cited

U.S. PATENT DOCUMENTS

| | | | |
|---|---|---|---|
| 3,114,853 | 12/1963 | Bouchard | 313/512 |
| 3,148,299 | 9/1984 | Devol et al. | 313/512 |
| 3,395,058 | 7/1968 | Kennedy | 313/512 X |
| 3,497,750 | 2/1970 | Knochel et al. | 313/511 |
| 3,509,401 | 4/1970 | Callely, Jr. et al. | 313/512 |
| 4,140,937 | 2/1979 | Vecht et al. | 313/503 |

FOREIGN PATENT DOCUMENTS

| | | |
|---|---|---|
| 1217805 | 5/1960 | France . |
| 1271699 | 7/1961 | France . |

*Primary Examiner*—David K. Moore
*Assistant Examiner*—K. Wieder
*Attorney, Agent, or Firm*—Lowe, Price, Leblanc, Becker & Shur

[57] ABSTRACT

An EL device is disclosed which comprises a transparent electrode provided directly on a moistureproofing member made of a light-transmitting sheet member, a light-emitting layer provided on the transparent electrode for emitting light, a back electrode provided on the light-emitting layer, and a protection member provided on the outside of the back electrode and bonded with the moistureproofing member at the circumference of the light-emitting layer, weighs considerably lighter than an EL device employing a glass substrate, and has a higher luminous characteristic as compared with a similar EL device employing light-transmitting sheet members. Since, the EL device employs fewer number of the expensive light-transmitting sheet members than the mentioned similar EL devices, it can be manufactured at lower cost and through simpler manufacturing processes.

4 Claims, 3 Drawing Sheets

Fig. 3
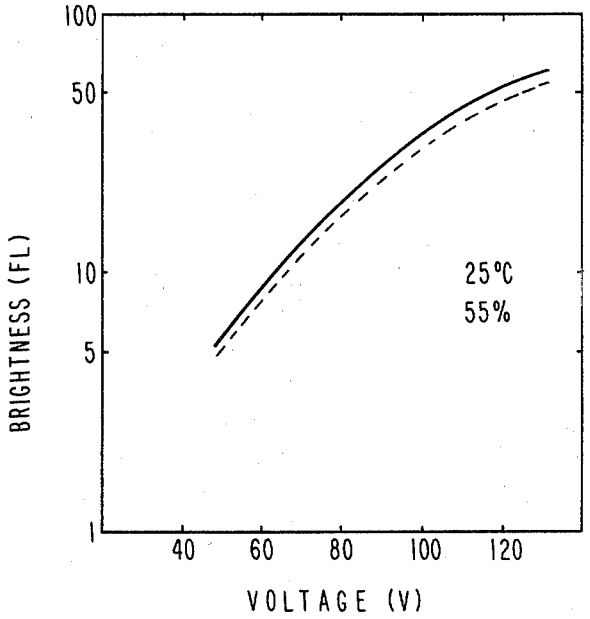
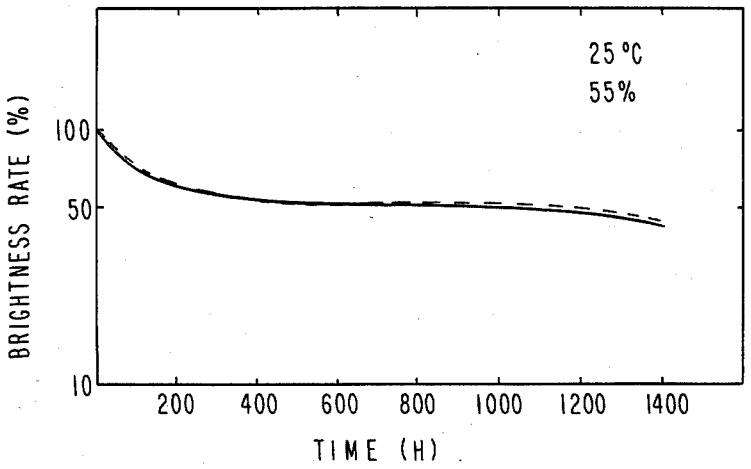
Fig. 4

Fig. 5
(PRIOR ART)
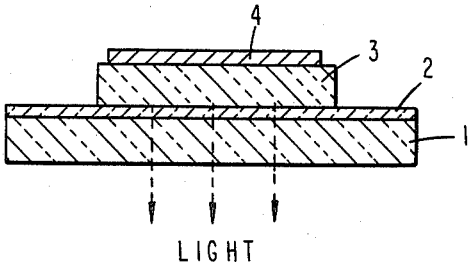
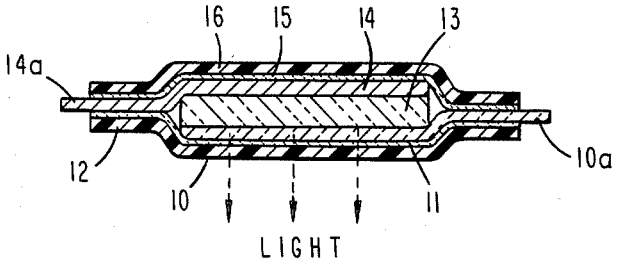
Fig. 6
(PRIOR ART)

LIGHT-EMITTING ELECTROLUMINESCENT DEVICE

This application is a continuation of application Ser. No. 806,775, filed Dec. 9, 1985, now abandoned.

BACKGROUND OF THE INVENTION

1. Field of the Invention

The present invention relates to an EL (electroluminescent) device which emits light when applied with an electric voltage.

2. Description of the Prior Art

An EL device which includes therein a lightemitting layer, or an electroluminescent layer, sandwiched between electrodes to emit light when D.C. or A.C. voltage is applied between the electrodes is disclosed, for example, in U.S. Pat. No. 4,140,937.

To make this device, a transparent electrode 2 is formed from transparent conductive material, such as tin oxide and indium oxide, on a glass substrate 1 as shown in FIG. 5 by evaporation or sputtering. Then, a substance made into paste form by dispersing such a phosphor material, which is composed of zinc sulfide or the like as the base material and copper to become luminescence centers and the like as active impurities added thereto, in such an organic binder as cellulosic resin is applied to aforesaid electrode and dried to be formed into a light-emitting layer 3. Over this layer is formed a back electrode 4 made of conductive metal with a good light reflecting property such as aluminum. When D.C. or A.C. voltage is applied between the transparent electrode 2 and the back electrode 4, a high electric field is developed within the light-emitting layer 3 and electrons in the conductor are excited and accelerated by the high electric field so as to be sufficiently energized to excite the aforesaid active substance, i.e., copper luminescence centers, and thus light is emitted when the excited copper luminescence centers return to the ground state.

Although such an EL device has an advantage in that its power consumption is lower than other surface luminescent devices such as a plasma display panel and fluorescent display tube, it has a disadvantage that the EL device as a whole becomes heavier in weight since the glass substrate 1 is heavy. Therefore, although such EL elements were suitable for the use in a fixed state, they were not suitable as light sources for displays, for example, for a show window, Christmas tree, or the like, which are used in a suspended state.

On the other hand, an EL device employing a light-transmitting sheet member instead of such a glass plate 1 is shown, for example, in U.S. Pat. No. 3,509,401.

To provide this device, as shown in FIG. 6, a light-transmitting sheet member such as a flat polyester film is used as its substrate, and by applying thereto transparent conductive material, such as tin oxide and indium oxide, by means of evaporation, sputtering, or the like, and cutting the film into a desired luminescent shape while providing the same with a transparent electrode terminal 10*a*, a transparent electrode 10 is thus formed.

Then, a moistureproofing member 12 made of a thermoplastic high polymer light-transmitting sheet member, such as chlorotrifluoroethylene film or composite film of chlorotrifluoroethylene film and polyethylene film, which is made to be somewhat larger than the transparent electrode 10 and provided with bonding agent 11 of olefinic series or the like on one side thereof, is disposed such that the surface applied with the bonding agent 11 is in contact with the mentioned light-transmitting sheet member forming the transparent electrode 10.

Then, a light-emitting layer 13 is formed on the transparent electrode 10 by means of screen printing or the like.

Thereafter, on the light-emitting layer 13 is disposed a back electrode 14 which is of the same constitution as the transparent electrode 10 or made of conductive metallic material having a good light reflecting property as aluminum. At this time, an electrode terminal 14*a* which is formed to be integral with the back electrode 14 and led out is disposed so as not to overlap the electrode terminal 10*a* of the transparent electrode 10.

Then, a moistureproofing member 16 of the same constitution as the aforementioned moistureproofing member 12 with bonding agent 15 of olefinic series or the like provided on one side thereof is disposed on the back electrode 14 such that the side applied thereon with the bonding agent 15 comes in contact with the back electrode 14 and both the electrode terminals 10*a*, 14*a* for the electrodes 10, 14 are partly exposed.

Finally, two moistureproofing members 12, 16 are fused together by a laminating method or the like under the heating condition at higher temperature than the plasticizing temperature of the same, and thus, the EL device is completed. The EL device of such constitution applied with the aforementioned voltage between its electrode terminals 10*a*, 14*a* emits light similarly to the previous one.

Since the above mentioned EL device uses, as the transparent electrode 10, a light-transmitting sheet member with a transparent conductive material disposed thereon, instead of the glass substrate 1 (refer to FIG. 5), it has an advantage that the EL device is much lighter in weight.

However, the light-transmitting sheet member used as the substrate for the transparent electrode 10 and the moistureproofing member 12 are inferior to the glass substrate 1 in the light-transmitting property, and further, the bonding agent 11 interposed between the transparent electrode 10 and the moistureproofing member 12 disturbs the transmission of light, and therefore, quantity of the light outwardly emitted from the light emitting layer 13 of the EL device is greatly reduced. Such low efficiency in the light emission was a disadvantage of this type of EL device

SUMMARY OF THE INVENTION

The present invention has been made in view of the above stated problems encountered in the prior art and has a primary object to provide an EL device which is lighter in weight and yet provides improved light emitting efficiency.

BRIEF DESCRIPTION OF THE DRAWINGS

FIG. 3 depicts a luminescence characteristic of the above EL device;

FIG. 4 is for showing aging characteristic of the above EL device; and

FIGS. 5 and 6 are both cross-sectional views of principal portions of prior art EL devices.

DESCRIPTION OF THE PREFERRED EMBODIMENTS

Figure 1:
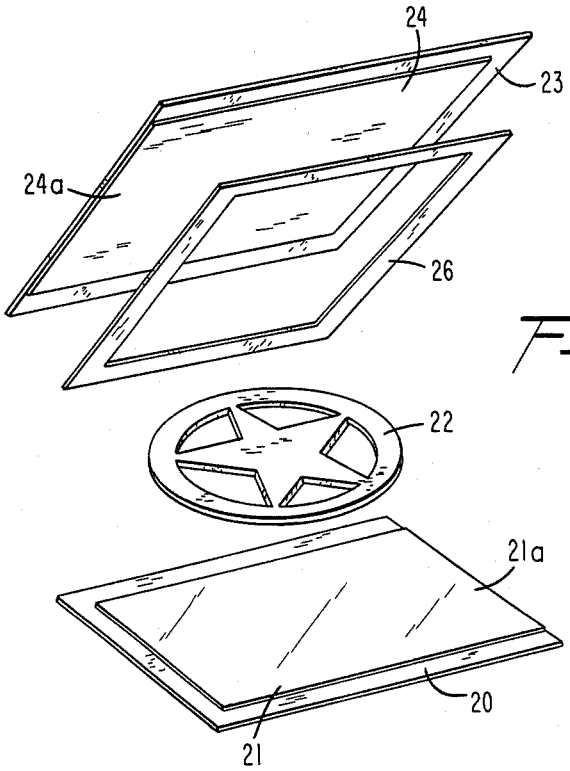
FIG. 1 is an exploded perspective view of a principal portion of an EL device of an embodiment of the invention.
Figure 2:
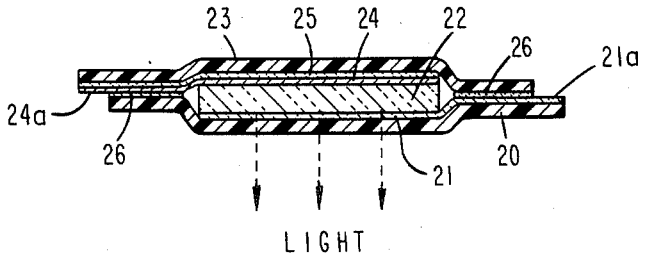
FIG. 2 is a cross-sectional view of a principal portion of the above EL device.

FIGS. 1 and 2 indicate structure of a preferred embodiment of the invention, wherein 20 denotes a moistureproofing member made of tens to hundreds microns thick thermoplastic high polymer light-transmitting sheet member of chlorotrifluoroethylene film or composite film of chlorotrifluoroethylene film and polyethylene film. A transparent electrode 21 is formed on the moistureproofing member 20 from transparent conductive material such as tin oxide, indium oxide, or the like, to the thickness of some hundred to some thousand Å. A light-emitting layer 22 is provided on the transparent electrode 21 to the thickness of tens to hundreds of microns by disposing thereon such a substance, which is prepared from a phosphor material composed of zinc sulfide, selenium sulfide, or the like as the base material and small quantity of active impurity to become luminescence centers such as copper and activator material such as chlorine added thereto and made into paste form by dispersing the phosphor material in an organic binder, such as cellulosic resin. A protection member 23 made of a tens to hundreds of microns thick thermoplastic sheet member of polyester film or the like, is formed into substantially the same shape as the moistureproofing member 20, and disposed to face the moistureproofing member 20 for protecting a back electrode to be described later, 24 denotes a back electrode tens to hundreds of microns thick, formed of conductive metallic material with good light reflectivity such as aluminum, bonded with the protection member 23 by bonding agent 25 of olefinic series or the like provided on one side of the protection member 23, and disposed so as to come in contact with the light-emitting layer 22, and 26 denotes bonding agent provided at the circumference of the light-emitting layer 22 for bonding the protection member 23 or back electrode 24 with the moistureproofing member 20 or transparent electrode 21. By the way, the layers of the bonding agent 25, 26 are tens of microns thick and the bonding agent 25 can be used also instead of the bonding agent 26. In order that the luminescence of the light-emitting layer 22 is improved, it is also possible to provide a dielectric layer formed of such dielectric substance as barium titanate and titanium oxide in between the light-emitting layer 22 and back electrode 24 by screen printing or the like to the thickness of tens to hundreds of microns. In the case where the back electrode 24 has a moistureproofing property, there is no need for the protection member 23 to have moistureproofing property, but if the back electrode 24 has no moistureproofing property, it is desired that the protection member 23 is constituted similarly to the moistureproofing member 20.

The method for manufacturing the EL device will be described in the following.

First, a back electrode 24 formed of about 50 microns thick aluminum is provided thereon with a layer about 40 microns thick of phosphor material by screen printing, the phosphor material being prepared from zinc sulfide with copper and chlorine added thereto and made into paste form by being dispersed in cyanoethylcellulose, and the layer is then dried at the temperature of about 100° C. for 10 to 30 minutes to be formed into a light-emitting layer 22.

A transparent moistureproofing member 20 of chlorotrifluoroethylene film about 70 microns thick is then provided with a transparent electrode 21 formed thereon to the thickness of about 500 Å by low temperature sputtering at 70° to 100° C. of transparent conductive material constituted of mixture of tin oxide and indium oxide.

Third, a protection member 23 formed of about 70 microns thick polyester film is provided with an olefinic series bonding agent 25 prepared on one side thereof to the thickness of about 30 microns, and on the same is bonded the back electrode 24 povided thereon with the light-emitting layer 22, and at the same time, about 30 micron thick olefinic series bonding agent 26 is provided on the back electrode 24 so as to surround the light-emitting layer 22. By the way, the use of the bonding agent 26 can be omitted by adapting such that the moistureproofing member 20 and protection member 23 are directly bonded together by the bonding agent 25 which is used for bonding the back electrode 24 to the protection member 23.

The moistureproofing member 20 is provided with the transparent electrode 21 disposed such that the transparent electrode 21 comes in contact with the light-emitting layer 22.

The circumferential portions of the moistureproofing member 20 and protection member 23 are now fused together by a laminating method under the heating condition at higher temperature than the plasticizing temperature of both the members 20, 23, while the electrode terminal **21*a* of the transparent electrode 21 and the electrode terminal 24*a* of the back electrode 24** are arranged to be exposed to outside, and thus an EL device of one-side emission type is completed.

Although the manufacturing sequence as described above was such that the light-emitting layer 22 was disposed on the back electrode 24 and the moistureproofing member 20 provided with the transparent electrode 21 was put over the light-emitting layer 22, the EL device can likewise be manufactured in the sequence such that the light-emitting layer 22 is disposed on the transparent electrode 21 provided on the moistureproofing member 20 and the protection member 23 provided with the back electrode 24 is put over the light-emitting layer 22.

Furthermore, it is possible to form the back electrode 24, instead of conductive metallic material with good light reflectivity like aluminum, by transparent, conductive material similar to the transparent electrode 21. In such a case, by preparing the protection member 23 in a moistureproofing material having similar moistureproofing capability as the moistureproofing member 20, then disposing the back electrode 24 on the protection member 23 in the same way as disposing the transparent electrode 21 on the moistureproofing member 20, and thereafter following the same procedures as described above, an EL device of double-side emission type can be completed.

It is a matter of course that the moistureproofing effect is made even greater in the case of the one-side emission type EL device in which the back electrode 24 is not made from a transparent, conductive material, if a material having the same moistureproofing capability as the moistureproofing member 20 is used for the protection member 23.

The thus manufactured EL device (FIG. 1 and FIG. 2) when applied with A.C. voltage at of frequency of about 400 Hz between the electrode terminals **21*a* and 24*a* emits light as indicated in FIG. 3 conforming to the shape of the EL layer 22**. It provides sufficient luminescence when used as a light source, for example, a display for a show window and Christmas tree (refer to the curve in a solid line in FIG. 3). Incidentally, it provides 10 to 15% higher luminescence as compared with the EL device (FIG. 6) of similar kind previously described by the applicant of the invention (refer to the curve in a broken line in FIG. 3).

Aging of the luminescence of the above described device is as shown in FIG. 4 and a good characteristic is obtained therefrom (refer to the curve in a solid line). It is confirmed that the present device provides a moistureproofing effect substantially equal to the conventional EL device which is structured by laminating several light-transmitting sheet members (refer to the curve in a broken line in FIG. 4).

What is claimed is:

1. An EL device comprising a transparent electrode directly on a moistureproofing member made of a light-transmitting sheet member, a light-emitting layer provided on said transparent electrode for emitting light, a back electrode made of a sheet-like member provided on said light-emitting layer, and a protection member provided on the outside of said back electrode and bonded with said moistureproofing member substantially only at a periphery of said light-emitting layer and with bonding material between said protection member and moistureproofing member, said transparent electrode and said back electrode each including an electrode terminal (21*a*,24*a*) of unitary, integral construction with its associated electrode and projecting beyond the periphery of said light-emitting layer, said electrode terminals being established by securing the sheet and sheet-like members forming the electrode together so they are partially offset with respect to each other.

2. An EL device according to claim 1, wherein said moistureproofing member is made of a thermoplastic high polymer light-transmitting sheet member.

3. An EL device according to claim 1, wherein said moistureproofing material is made of a light-transmitting sheet member constituted of chlorotrifluoroethylene film.

4. An EL device according to claim 1, wherein said protection member is a moistureproofing member similar to said moistureproofing member.

* * * * *